US006186188B1

(12) United States Patent
Horter et al.

(10) Patent No.: US 6,186,188 B1
(45) Date of Patent: Feb. 13, 2001

(54) WEAVING MACHINE SYSTEM AND MECHANISM FOR COUPLING LIFTING DEVICES AND WARP THREAD HARNESS CARDS

(75) Inventors: Hansjürgen Horter, Deizisau; Fritz Bayer, Neckartailfingen; Rolf Guse, Reutlingen, all of (DE)

(73) Assignee: Deutsche Institute für Textil und Faserforschung Stuttgart Stifftung des öffentlichen Rechts (DE)

( * ) Notice: Under 35 U.S.C. 154(b), the term of this patent shall be extended for 0 days.

(21) Appl. No.: 09/386,007

(22) Filed: Aug. 30, 1999

(30) Foreign Application Priority Data

Aug. 28, 1998 (DE) ..... 198 39 319

(51) Int. Cl.[7] ..... D03C 3/40; D03C 3/38
(52) U.S. Cl. ..... 139/85; 24/702
(58) Field of Search ..... 139/85; 24/702, 24/116 A, 579.1

(56) References Cited

U.S. PATENT DOCUMENTS

| | | | | |
|---|---|---|---|---|
| 1,225,216 | * | 5/1917 | Boyer | 24/579.1 |
| 2,765,509 | * | 10/1956 | Brehm | 24/702 |
| 3,147,507 | * | 9/1964 | Glynn | 24/702 |
| 3,172,178 | * | 3/1965 | Copell | 24/116 A |
| 4,034,782 | | 7/1977 | Bucher | 139/85 |
| 4,216,567 | * | 8/1980 | Heinz | 24/116 A |
| 4,520,537 | * | 6/1985 | Valikov | 24/116 A |
| 5,157,861 | * | 10/1992 | Peterson | 24/116 A |
| 5,309,950 | | 5/1994 | Bassi | 139/88 |
| 5,636,663 | | 6/1997 | Lacroix | 139/86 |
| 5,671,782 | | 9/1997 | Lemaire et al. | 139/85 |
| 5,774,957 | * | 7/1998 | Kohl et al. | 24/702 |
| 5,836,061 | * | 11/1998 | Castillo et al. | 24/702 |

FOREIGN PATENT DOCUMENTS

| | | |
|---|---|---|
| 4213958 | 4/1993 | (DE) . |
| 4306978 | 9/1994 | (DE) . |
| 19526177 | 1/1996 | (DE) . |
| 29801698 | 5/1998 | (DE) . |
| 0421370 | 4/1991 | (EP) . |
| 0546967 | 6/1993 | (EP) . |
| 0709503 | 5/1996 | (EP) . |

OTHER PUBLICATIONS

European Search Report No. 99112867.9 of Jan. 11, 2000.

* cited by examiner

*Primary Examiner*—Andy Falik
(74) *Attorney, Agent, or Firm*—Ostrolenk, Faber, Gerb & Soffen, LLP

(57) ABSTRACT

A coupling device for the releasable connection of a lifting element, in particular of a jacquard machine, to at least one lifting element of a warp thread in a weaving machine. The preferred coupling device connects a sinker cord of a jacquard machine to a harness cord of the harness of a weaving machine. The coupling device has a first coupling part assigned to the lifting element and a second coupling part assigned to the harness cord. The coupling parts execute a radial relative movement during coupling and uncoupling. The coupling device provides for rotational alignment of the two coupling parts with one another. At least one coupling part is assigned or capable of being assigned a rotational alignment mechanism. The coupling device is used in a system which rapidly connects and disconnects many connectors at the same time. The system includes a positioning mechanism for vertically moving two positioning elements which operate the coupling devices between standby and operative positions, and for horizontally moving at least one of the positioning elements to cause the coupling parts of each coupling device to interlock and disengage. The positioning elements also cooperate with portions of at least one of the coupling parts to rotationally align the coupling parts so they may interlock.

26 Claims, 9 Drawing Sheets

WEAVING MACHINE SYSTEM AND MECHANISM FOR COUPLING LIFTING DEVICES AND WARP THREAD HARNESS CARDS

BACKGROUND OF THE INVENTION

1. Field of the Invention

The invention relates to a coupling device for the releasable connection of a lifting element, in particular of a jacquard machine, to at least one lifting element of a warp thread in a weaving machine. More particularly, the invention relates to a coupling device for the releasable connection of a sinker cord of a jacquard machine to a harness cord of the harness of a weaving machine.

2. Description of the Related Art

Coupling devices of the general type referred to here are known. See U.S. Pat. No. 4,034,782, for example. These comprise two coupling parts, of which a first coupling part is assigned to the lifting element formed by a cord and a second coupling part is assigned to the harness cord. During coupling and uncoupling, the coupling parts execute in relation to one another a relative movement that is radial to the direction of displacement of the lifting element or of the harness cord. Disadvantageously, the separation and connection of the harness and the jacquard machine or of individual harness cords from and to the respective lifting elements of the jacquard machine have to be carried out manually, which takes up a relatively long period of time. Consequently, the idle times of the weaving machine are increased.

SUMMARY OF THE INVENTION

The present invention provides a coupling device which does not have the disadvantages of the prior art, such as those noted above. The coupling device of the present invention provides for automated mutual rotational alignment of the two coupling parts. At least one coupling part is assigned or is capable of being assigned a rotational alignment means.

Consequently, it is possible to connect and release a lifting element, for example a harness cord, or a plurality of lifting elements, in particular harness cords, for example combined in groups, quickly to and from the respective lifting element of a jacquard machine, for example. As referred to herein, a radial displacement of the coupling parts, used to disconnect the two parts, is a displacement transverse to the direction of displacement (axial direction) of the lifting elements, which is in the vertical or essentially vertical direction.

The rotational alignment means acts, according to a first design variant, on the coupling part constantly (FIGS. 11A to 11C) or, according to another design variant, only during coupling and uncoupling.

In an advantageous exemplary embodiment of the coupling device, at least one of the coupling parts has a noncircular cross-sectional portion, over which a locating member engages for rotational alignment. Rotational alignment preferably takes place by the locating member and the one coupling part executing an axial relative movement in relation to one another. In other words, the locating member and/or the coupling part are displaced in the direction of displacement of the lifting element, and the rotational alignment of the coupling part takes place during the displacement operation or is initiated and carried out as a result of the engaging-over action.

In a further preferred embodiment of the coupling device, the noncircular cross-sectional portion of the at least one coupling part is twisted on itself axially, as is explained more fully below. As a result, when the cross-sectional portion engages into the locating member or tool, preferably formed by a recess or a passage orifice of a positioning element, desired rotational alignment is induced, preferably about the longitudinal center axis of the lifting element, generally hanging down vertically from the jacquard machine, of the coupling part which has the noncircular cross-sectional portion. The recess or the passage orifice may, if appropriate, also be twisted on itself, the pitch of the cross-sectional portion twisted on itself and of the recess or passage orifice being selected or mutually coordinated in such a way that self-locking does not occur when the two coupling parts are moved toward one another.

An exemplary embodiment of the coupling device is also preferred in which a plurality of recesses or passage orifices, which are each assigned a coupling part, are formed in the positioning element. As a result, by a displacement of the positioning element, a plurality, in particular hundreds or thousands, of lifting elements, for example harness cords, can be simultaneously separated from and connected to the respective lifting element, in particular of a jacquard machine. It is consequently possible for the harness of the weaving machine to be changed quickly, as a result of which the stoppage times of the weaving machine can be reduced.

Of course, in another exemplary embodiment, the reverse situation is also possible, specifically that in which the lifting elements are separated from the harness cords. For this purpose, the first coupling part executes a radial relative movement in relation to the second coupling part.

A further preferred embodiment of the coupling device has each of the two coupling parts assigned a positioning element. The coupling parts can thereby be aligned separately from one another axially, in the direction of the raising and lowering movement of the lifting elements, and radially, in the coupling direction and transversely to the direction of displacement of the lifting elements of the jacquard machine.

Finally, in a further embodiment of the coupling device, the two positioning elements have a plurality of recesses or passage orifices which, in the coupling position when the coupling device is in the coupled state, are axially in alignment with one another or offset relative to one another. Accordingly, in a first design variant of the coupling parts, at least their noncircular cross-sectional portions, over which at least one locating member engages in each case, are arranged opposite one another. In another design variant not illustrated in the figures, the cross-sectional portions bringing about rotational alignment of the coupling parts are arranged so as to be offset relative to one another, as seen in the axial direction, transversely to the coupling/uncoupling direction.

Other features and advantages of the present invention will become apparent from the following description of the invention which refers to the accompanying drawings.

BRIEF DESCRIPTION OF THE DRAWINGS

The invention is explained in more detail below with reference to the drawing in which.

DETAILED DESCRIPTION OF THE INVENTION

The coupling device described below may be used, in general, for the releasable connection of lifting elements, for example cords, bars or the like, that is to say of pull and/or push means. It is assumed below, purely by way of example, that the lifting elements here are those of a jacquard machine which is capable of being coupled to lifting elements of warp threads of a weaving machine, the lifting elements being formed by harness cords.

Figure 1:
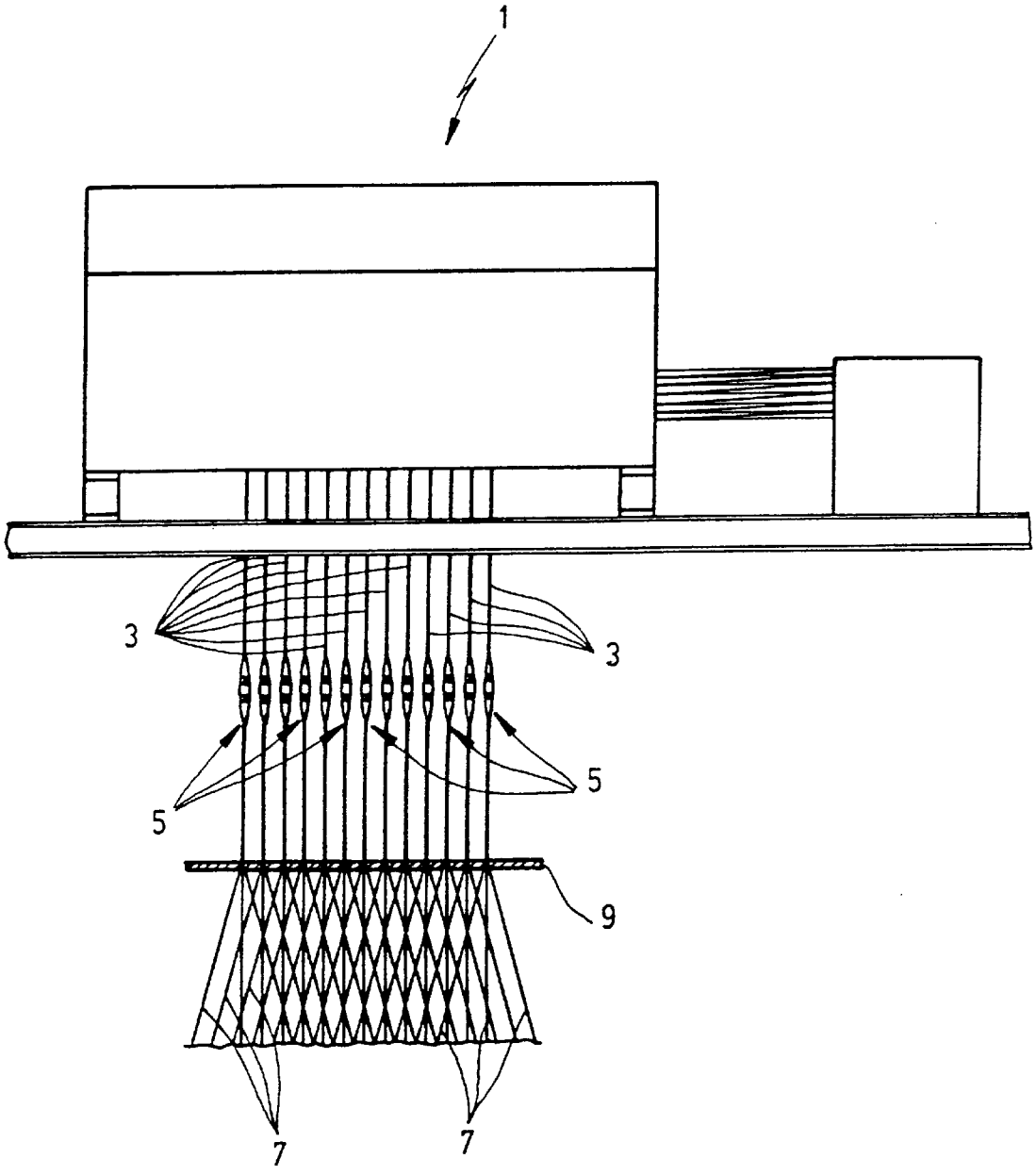
FIG. 1 shows a side view of an exemplary embodiment of a jacquard machine.

FIG. 1 shows a side view of an exemplary embodiment of a known jacquard machine 1 arranged above a weaving machine which is not illustrated. The jacquard machine 1 comprises a number of lifting elements 3 which are formed, here, by cords connected directly to the sinkers of the jacquard machine 1 via pulley assemblies. The lifting element used for the jacquard machine may, for example, also consist of bars or rods. The design of the jacquard machine is generally known, so that it is not described in any more detail here.

Each of the lifting elements 3 is releasably connected, in each case via a coupling device 5, to one or more harness cords 7 of a harness of the weaving machine. In the exemplary embodiment illustrated in FIG. 1, the lifting elements 3 are connected in each case to three harness cords 7, the harness cords assigned to a lifting element 3 being in each case guided through a perforation in a guide deck 9, for example a glass grid or a perforated board. The design and functioning of the coupling devices 5 are explained in more detail below with reference to the rest of the figures.

Figures 2, 3:
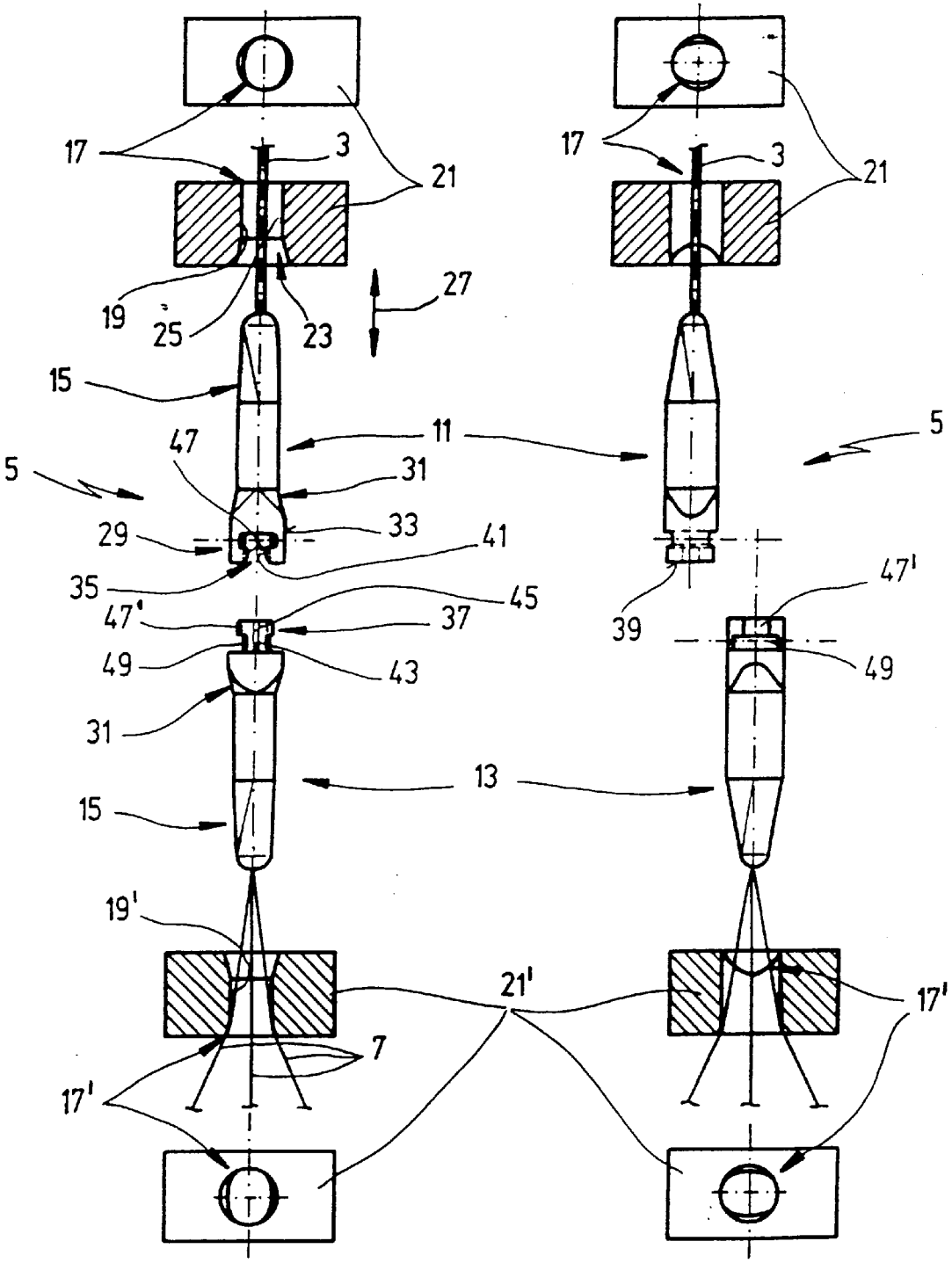
FIG. 2 shows a side view of a first exemplary embodiment of the coupling device according to the invention in the uncoupled state.
FIG. 3 shows a further side view of the coupling device according to FIG. 2, which is rotated through 90° in relation to the view illustrated in FIG. 2.

FIGS. 2 and 3 each show a side view of a first exemplary embodiment of a coupling device 5 in the noncoupled state. The coupling device has a first coupling part 11 assigned to the lifting element 3 and a second coupling part 13 assigned to at least one harness cord, here altogether three harness cords 7. The first coupling part 11 comprises, at the end at which the lifting element 3 is fastened, a noncircular oval cross-sectional portion 15, over which a locating member 17 engages for the rotational alignment of the first coupling part.

In the exemplary embodiment illustrated in FIGS. 2 and 3, the locating member 17 is a passage orifice 19 which is introduced into a positioning element 21 formed by a plate. The lifting element 3, formed by a sinker cord, tie or the like, is led through the passage orifice 19. The passage orifice 19 has, at its edge region facing the coupling part 15, a conical initial portion 23 which has a circular-cylindrical base area which has adjoining it a cylindrical portion 25 with an oval cross section. Alternatively, it is possible for the entire passage orifice to be of conical design.

The shape of the cross section of the passage orifice 19 is adapted to the shape of the noncircular cross-sectional portion 15 of the coupling part 11. Furthermore, the cross-sectional portion 15 is twisted on itself. For rotational alignment of the coupling part 15, the positioning element 21 displaceable in the direction of the double arrow 27 is displaced downward, so that the locating member 17 engages over the cross-sectional portion 15 of the coupling part 11. When the coupling part 11 penetrates or engages with its cross-sectional portion 15 into the passage orifice 19, the coupling part 11 is rotated about its longitudinal center axis.

The coupling part 11 has, at its end facing away from the positioning part 21, a portion 29 of larger diameter, on which is formed a projection 31 limiting the axial movement of the coupling part 11. In the region of the portion 29, the coupling part 11 has a receptacle 35 which is open toward the lateral surface 33 and into which a holding projection 37 of the second coupling part 13 is capable of being introduced radially, transversely to the direction of displacement (double arrow 27) of the lifting element 3. The receptacle 35 is also designed, here, so as to be open toward the bottom surface 39 of the coupling part 11. The coupling part 11 thereby takes the form of a claw in the region of the receptacle 35.

Furthermore, the receptacle 35 has a cross-sectional narrowing 41 in its lower region, so that the free space forming the receptacle is T-shaped. The shape of the receptacle and the shape of the holding projection are adapted to one another. The holding projection 37, which is T-shaped in this exemplary embodiment, has a cross-sectionally tapered neck 43 and a cross-sectional widening 45 adjoining the neck 43 toward the free end. During the coupling and uncoupling of the coupling device 5, the neck 43 of the holding projection 37 passes the cross-sectional narrowing 41 of the receptacle 35. By virtue of this design, the two coupling parts 11, 13 are necessarily rotationally aligned and brought into a defined height position for the purpose of connecting the coupling device 5.

As is apparent from FIGS. 2 and 3, the two coupling parts differ from one another only in their end regions cooperating with one another, in that one coupling part has a receptacle and the other a holding projection. For rotational alignment, a locating member 17' engages over the coupling part 13, which likewise has a noncircular, here oval cross-sectional portion 15, the locating member being introduced in the form of a passage orifice 19' in a positioning element 21' displaceable in the direction of the double arrow 27.

As a safeguard against the two coupling parts slipping one out of the other laterally in the coupled state, the receptacle 35 has, as seen in the radial receptacle push-in direction, on its wall region, on both sides, here altogether two projections 47 which, during coupling and uncoupling, are overcome by the holding projection 37 on the second coupling part 13 with effort in order to achieve a snap fit. In accordance with the form which the snap fit takes, the ribs 49 provided in the region of the neck 43 of the holding projection 37 engage behind the projections 47, thereby securing the coupling device 5 against inadvertent release. During coupling and uncoupling, therefore, the receptacle, which is designed as a claw and which consists of an elastic material, for example plastic, has to be widened. In this exemplary embodiment, a further safeguard against radial displacement of the two coupling parts 11, 13 is provided. For this purpose, the holding projection 37 has in the region of its cross-sectional widening 45, as seen in the radial push-in direction, a plurality of projections 47' which, during coupling and uncoupling, widen the claw (the receptacle 35) on the first coupling part 11 in order to achieve or release a snap fit. In order to safeguard the coupling parts in the lateral direction, the ribs may have convex curvature and the corresponding recess may have concave curvature (or vice versa.).

A particular advantage of the radial relative movement of the two coupling parts during coupling and uncoupling is that, when the weaving machine is in operation, the axially acting tensile forces in the coupling device 5 act transversely or essentially transversely to the coupling/uncoupling direction. The forces to be exerted during coupling/uncoupling are therefore independent of the tensile forces involved in lifting the warp threads. Chamfers made on the holding projection 37 and the receptacle 35, the chamfers not being illustrated in FIGS. 2 and 3, make it easier to couple the coupling device and at the same time give rise, in the axial and radial direction, to some tolerance compensation when a large number of identical coupling devices are actuated simultaneously.

During coupling and uncoupling, the oval cross-sectional portion 15, which is introduced in the passage orifice 19 or 19' during the rotational alignment of the coupling parts 11, 13, absorbs the reaction forces acting transversely to the longitudinal axis or direction of displacement (double arrow 27) of the lifting element and additionally maintains the lateral alignment of the two coupling parts. The shape of the cross-sectional portion 15 serving for rotational alignment may, for example, also be rectangular or the like, instead of oval. It is important that the shape of the cross-sectional portion 15 makes centering or rotational alignment of the coupling part possible. The obliquely running projection 31 of the coupling parts 11, 13 makes it possible, moreover, to reinforce the axial centering of the coupling parts during coupling and, furthermore, makes it possible for the coupling devices arranged next to and at a distance from one another not to be capable of catching on one another when the jacquard machine is in operation.

Figure 4:
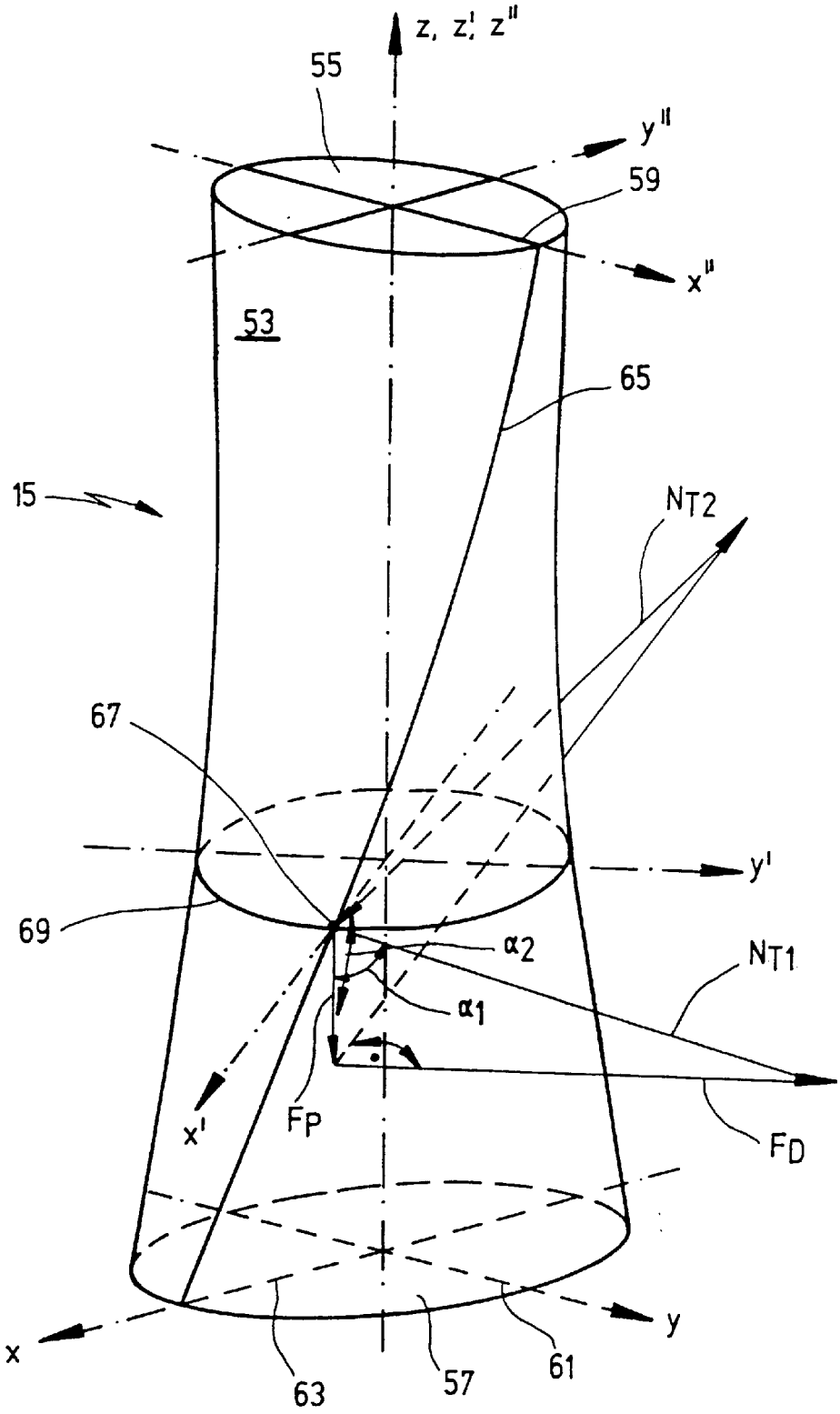
FIG. 4 shows a perspective illustration of a portion of a coupling part of the coupling device.

FIG. 4 shows a perspective illustration of an exemplary embodiment of the noncircular cross-sectional portion 15 of the coupling parts 11, 13. The portion is formed by a cone frustum which is twisted on itself at 90° about its longitudinal center axis and which has an oval cross-sectional surface. The cone frustum 53 has a small enveloping surface 55 and a large enveloping surface 57. The longitudinal center axis of the cone frustum 53 is in alignment with the z-, z'- and z"-axis of the x–y–z/x'–y'–z'/x"–y"–z" systems of coordinates. The small enveloping surface 55 lies in the plane spanned by the x"- and y"-axis and the large enveloping surface 57 lies in the plane spanned by the x- and y-axis. The major axis 59 of the small enveloping surface 55 is equal to or smaller than the minor axis 61 of the large enveloping surface 57 and somewhat smaller than the minor axis of the oval portion 25 of the passage orifice 19, 19' in the positioning element 21 or 21'.

Figure 5A:
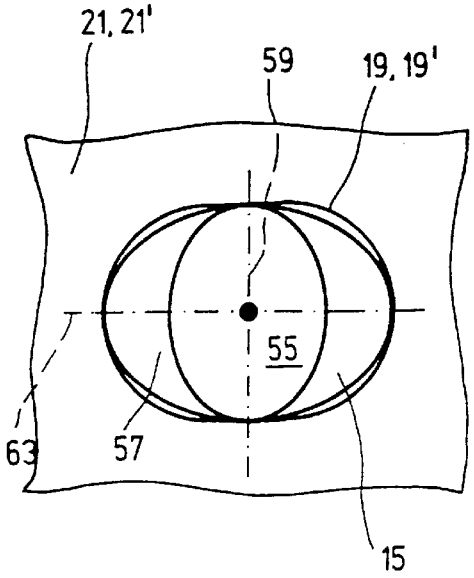
FIGS. 5A and 5B each show a top view of a locating member formed by a recess or passage orifice.

The twist of the cone frustum 53 is selected, here, in such a way that, when the cone frustum 53 is in the correct lateral position in relation to the oval portion of the passage orifice 19 or 19' (see FIG. 5A), the major axis 63 of the large enveloping surface 57 lies below the major axis of the oval portion of the passage orifice 19, 19' in the positioning element 21, 21', and the major axis 59 of the small enveloping surface 55 lies below the minor axis of the oval portion of the passage orifice 19, 19'. When the cone frustum 53 is arranged as illustrated in FIG. 5A, which shows a detail of the coupling device in the region of the passage orifice 19, 19', the positioning element 21, 21', when being displaced axially, perpendicularly to the drawing plane of FIG. 5A, can be displaced as far as a stop-forming projection 31 of the coupling part 11, 13, without the latter rotating at the same time.

Figure 5B:
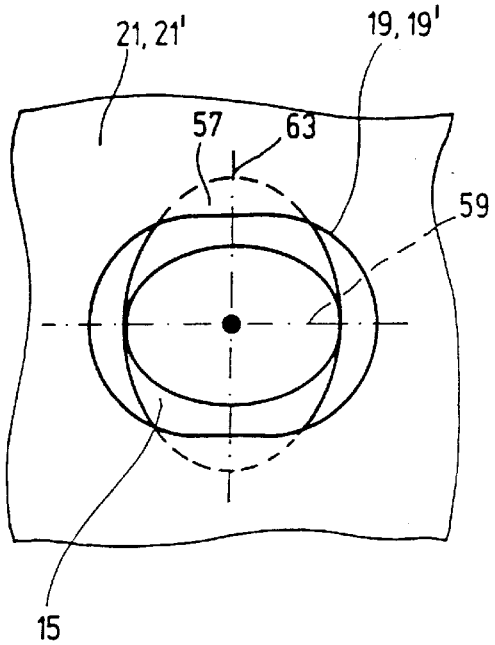

In an incorrect twisted lateral position, as illustrated in FIG. 5B, in which the cone frustum 53 is arranged so as to be twisted at 90° to the oval portion 25 of the passage orifice 19, 19', in the case of the maximum deviation the major axis 63 of the large enveloping surface 57 lies below the minor axis of the oval portion of the passage orifice 19, 19' in the positioning element 21, 21' and the major axis 59 of the small enveloping surface 55 lies below the major axis of the oval portion of the passage orifice. During axial displacement of the positioning element 21, 21', the edges of the long sides of the oval cross-sectional portion of the passage orifice slide along on the widening helix 65 of the cone frustum 53 and at the same time rotate the cone frustum 53, and consequently the coupling part 11, 13, automatically into the correct position.

The helix 65 illustrated on the outer surface of the oval and twisted cone frustum 53 illustrated in FIG. 4 starts at the point of intersection of the major axis of the oval enveloping surface with the contour of this surface and goes in the same direction as the rifling or twisting of the cone frustum 53, as seen in the direction of the z-axis. When the positioning element 21, 21' is pressed onto the cone frustum 53, the latter is touched along such a helix and, by virtue of the spatial pitch, is centered in the radial direction and at the same time aligned in the lateral direction, that is to say radially to the displacement movement of the lifting element 3.

When a longitudinal edge of a correspondingly designed recess or the like, here of the passage orifice 19, 19', meets the helix in a twisted position of the cone frustum, at this instantaneous point of contact 67 the spatial tangent of the spiral helix 65 can be projected, on the one hand, onto the y'–z' plane and, on the other hand, onto the x'–z' plane, as illustrated in FIG. 4. The point of contact 67 is located in the instantaneous cross-sectional surface 69. The pitch of the tangent in the y'–z' plane (pitch angle $\alpha_1$) constitutes the pitch of the pure helix without any taper and is responsible for the rotational movement. The pitch angle $\alpha_1$ is drawn against the normal $N_{T1}$ of the tangent in the y'–z' plane to the pressure force $F_P$. Without the friction being taken into account, the rotational force $F_D$, which points tangentially in the y' direction on the instantaneous cross-sectional surface is obtained via the pitch angle $\alpha_1$. The pitch of the tangent in the x'–z' plane (pitch angle $\alpha_2$) constitutes the slant (taper) of the cone frustum at the instantaneous point of contact 67 and thereby gives rise to the centering movement.

The pitch angle $\alpha_2$ is drawn against the normal $N_{T2}$ of the tangent in the x'–z' plane to the pressure force of the positioning element. Without the friction being taken into account, the centering force, which passes radially through the z'-axis (surface center point) in the x' direction on the instantaneous cross-sectional surface 69, is obtained via the pitch angle $\alpha_2$. If the positioning element first butts on the outer surface of the cone frustum at only one point of contact, when the coupling part is moved further into the passage orifice of the positioning element the coupling part is centered relative to the longitudinal center axis of the passage orifice, until the opposite sides of the cone frustum 53 come into contact with those of the passage orifice. The pressure force of the positioning element is then apportioned to both points of contact on the outer surface of the cone frustum.

When abutment at one point of contact takes place, the rotational movement is initiated via the rotational force, with the friction, the translational (radial compensating movement) and rotational mass moment of inertia and the polar moment of resistance of the lifting element 3 or of the harness cord or harness cords 7 being overcome. When pressure on the two opposite points of contact occurs, the pressure force is apportioned to both points of contact and the rotational movement continues positively. If friction is ignored, the rotational force $F_D$ is obtained, as described, from the pitch angle $\alpha_1$, and the centering force is obtained from the pitch angle $\alpha_2$ and, furthermore, from the instantaneous perpendicular position of the cone frustum at one or both points of contact.

The aligning movement of the coupling parts in the recesses or passage orifices of the positioning elements may be made easier, for example at locations where there is increased friction, by jogging, for example by means of a microstroke, or knocking the positioning element or positioning elements.

FIGS. 6A to 6D show a perspective illustration of the coupling device 5 in several phases of a coupling operation. Identical parts are given the same reference symbols, so, to that extent, reference is made to the description of the previous figures. The positioning element 21' cooperating with the second coupling part 13 is moved axially in the direction of the arrow 27 vertically upward in the direction of the first coupling part 11 which is rotationally aligned with the aid of the positioning element 21 and dwells in a fixed position, the positioning element 21' being offset laterally relative to the longitudinal center axis of the lifting element 3 hanging down.

Figures 6A, 6B, 6C, 6D:
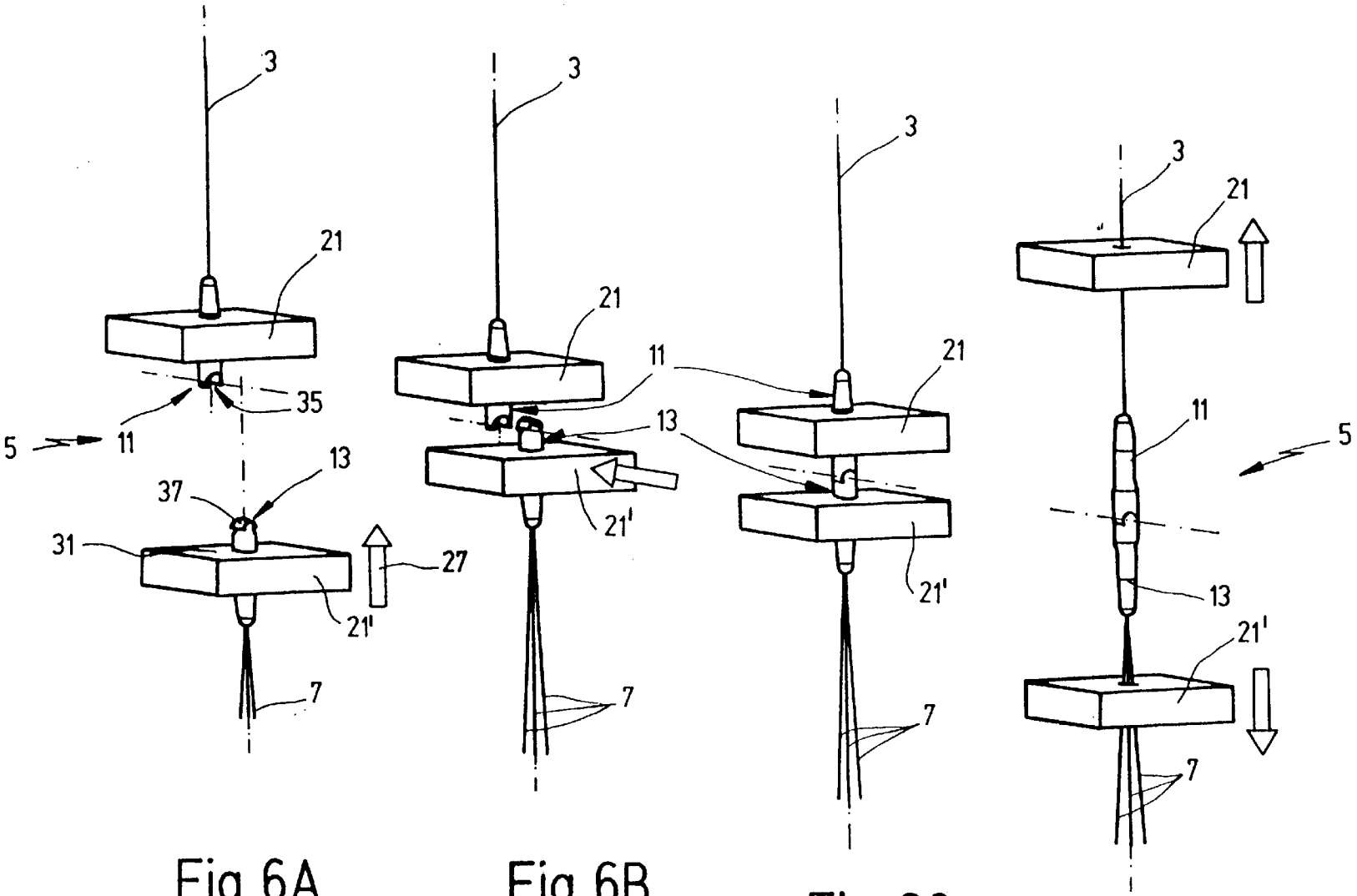
FIGS. 6A to 6D in each case show a perspective illustration of two coupling parts during a coupling operation, in various functional positions.

After a defined height position illustrated in FIG. 6B is reached, the lower positioning element 21' is displaced in the direction of the first coupling part 11 by means of a radial/transverse movement, until the holding projection 37 on the second coupling part 13 has been moved, caught or snapped, into the receptacle 35 provided on the first coupling part 11.

When the two coupling parts are in the coupled or interlocked state (FIG. 6C), the two positioning elements 21, 21' are moved apart from one another upward and downward respectively, as illustrated in FIG. 6D, until the distance between the two positioning elements is such that, when the jacquard machine is running, a free lifting movement of the lifting element 3 or harness cords 7 in the passage orifices 19, 19' is possible.

The uncoupling operation, which is not illustrated in the figures, takes place in reverse order. In order to exchange the harness or one or more harness cords, after the jacquard machine has been stopped the positioning elements 21, 21' are displaced downward and upward, until they butt onto the projection 31 of the coupling parts 11, 13. This position corresponds to the position illustrated in FIG. 6C. By means of a radial relative movement of the lower positioning element 21', the second coupling part 13 is pressed laterally out of the first coupling part 11. The positioning element 21', together with the second coupling part 13 hanging on it, is then lowered. The positioning element 21 assigned to the first coupling part 11 remains in its position illustrated in FIGS. 6A to 6C, which also at the same time constitutes the initial position for a new coupling operation.

It becomes readily apparent from what was said above that the positioning elements 21, 21' may also be used for the simultaneous rotational alignment of a plurality of harness cords, for example combined in groups, or of all the harness cords of the harness. For this purpose, the positioning element in each case has, for each lifting element 3, a recess or passage orifice which can be pushed over the noncircular, for example oval or rectangular cross-sectional portion 15 of the coupling part 11 or 13, with the result that rotational alignment of the coupling part takes place. With the aid of the positioning elements 21, 21', it is therefore possible simultaneously to couple or uncouple a plurality or all of the coupling devices connected to a lifting element of the jacquard machine.

Figure 7:
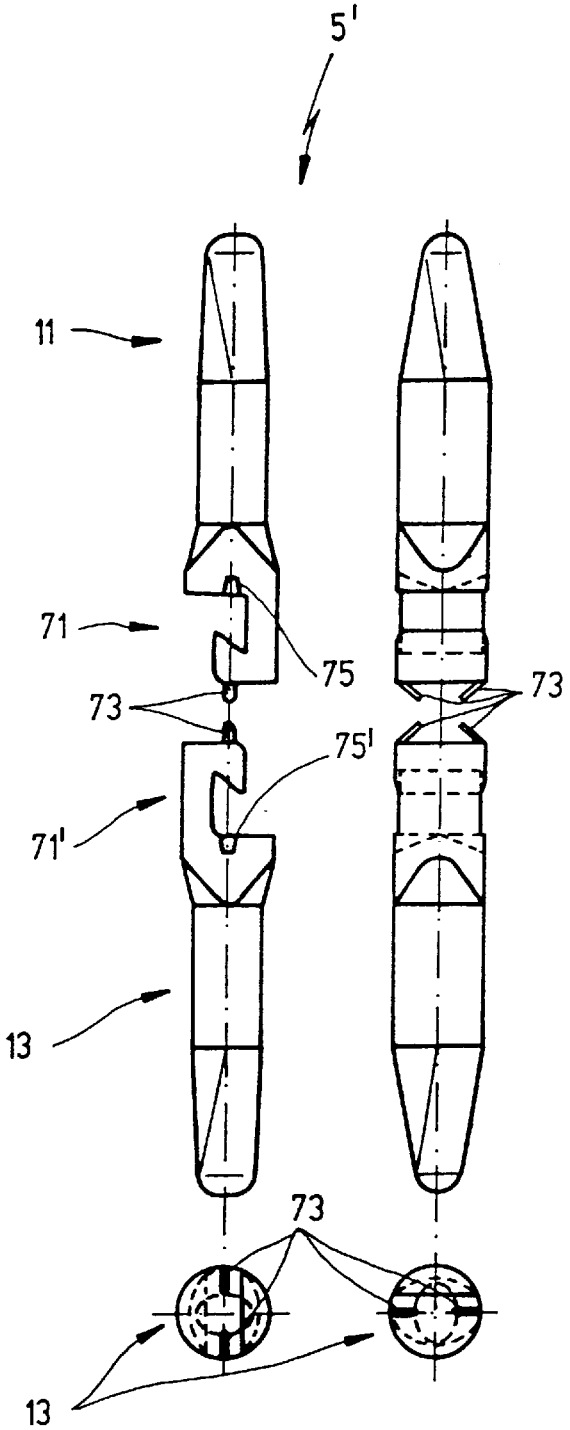
FIG. 7 shows two side views of a further exemplary embodiment of a coupling device comprising two coupling parts, in the uncoupled state.
Figure 8:
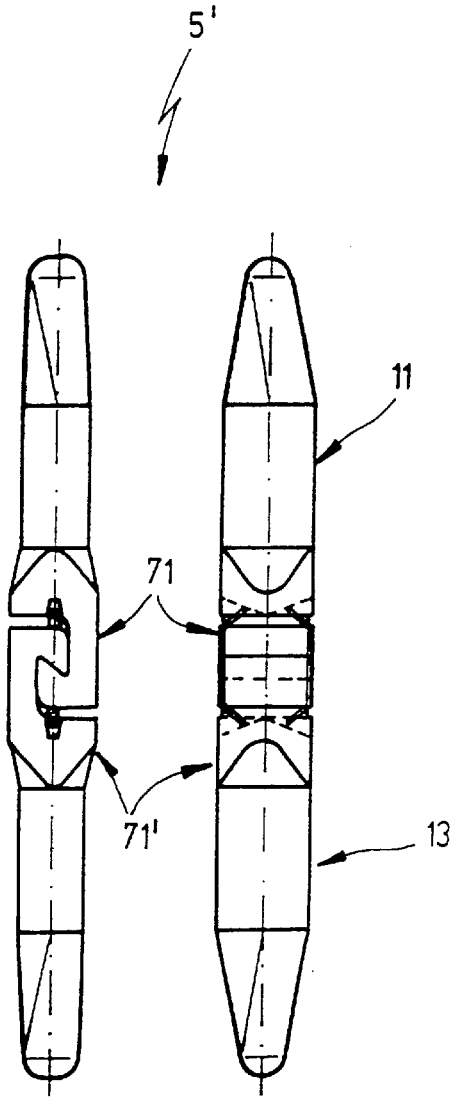
FIG. 8 shows two side views of the coupling parts illustrated in FIG. 7, in the coupled state.

FIGS. 7 and 8 each show a side view of two pictures of a further exemplary embodiment of the coupling device 5' having two coupling parts 11, 13 which are capable of being coupled and uncoupled as a result of radial displacement. The coupling device 5' is illustrated in the uncoupled state in FIG. 7 and in the coupled state in FIG. 8. The coupling device 5' differs from the coupling device 5 described with reference to the previous figures, particularly in that the coupling parts 11, 13, instead of having the receptacle 35 and the holding projection 37, each now has two, here identical hooks 71 and 71' which are open to the lateral surface of the coupling parts and which can be laterally pushed one into the other perpendicularly to the drawing plane of the picture on the left in FIG. 7.

During the closing of the coupling device 5', the deformable tabs 73 located on the end face of the coupling parts 11, 13 snap into corresponding grooves 75 and 75' which are introduced into the coupling parts 11, 13 in the region of the hooks 71. For uncoupling, the tabs 73 have to be pressed out of the grooves 75 and 75' by means of a radial relative movement of the two coupling parts 11, 13 in relation to one another. With the aid of the tabs 73, the coupled coupling device is safeguarded against the two coupling parts inadvertently slipping one out of the other laterally. In the exemplary embodiment of the coupling device 5' illustrated in FIGS. 7 and 8, the two coupling parts 11, 13 are designed identically, with the result that the costs of the coupling device can be reduced.

The harness cords 7 or other lifting elements for the warp threads and the lifting elements, for example a sinker cord, of the jacquard machine can be fastened to the coupling parts 11, 13 in various ways. FIGS. 9A–9E illustrate variants of the fastening of the harness cords 7 or of an individual harness cord to the second coupling part 13. Of course, the first coupling part 11, to which the lifting element (sinker cord or the like) is fastened or appropriately held, may also be designed identically.

Figures 9A, 9B, 9C, 9D, 9E, 10:
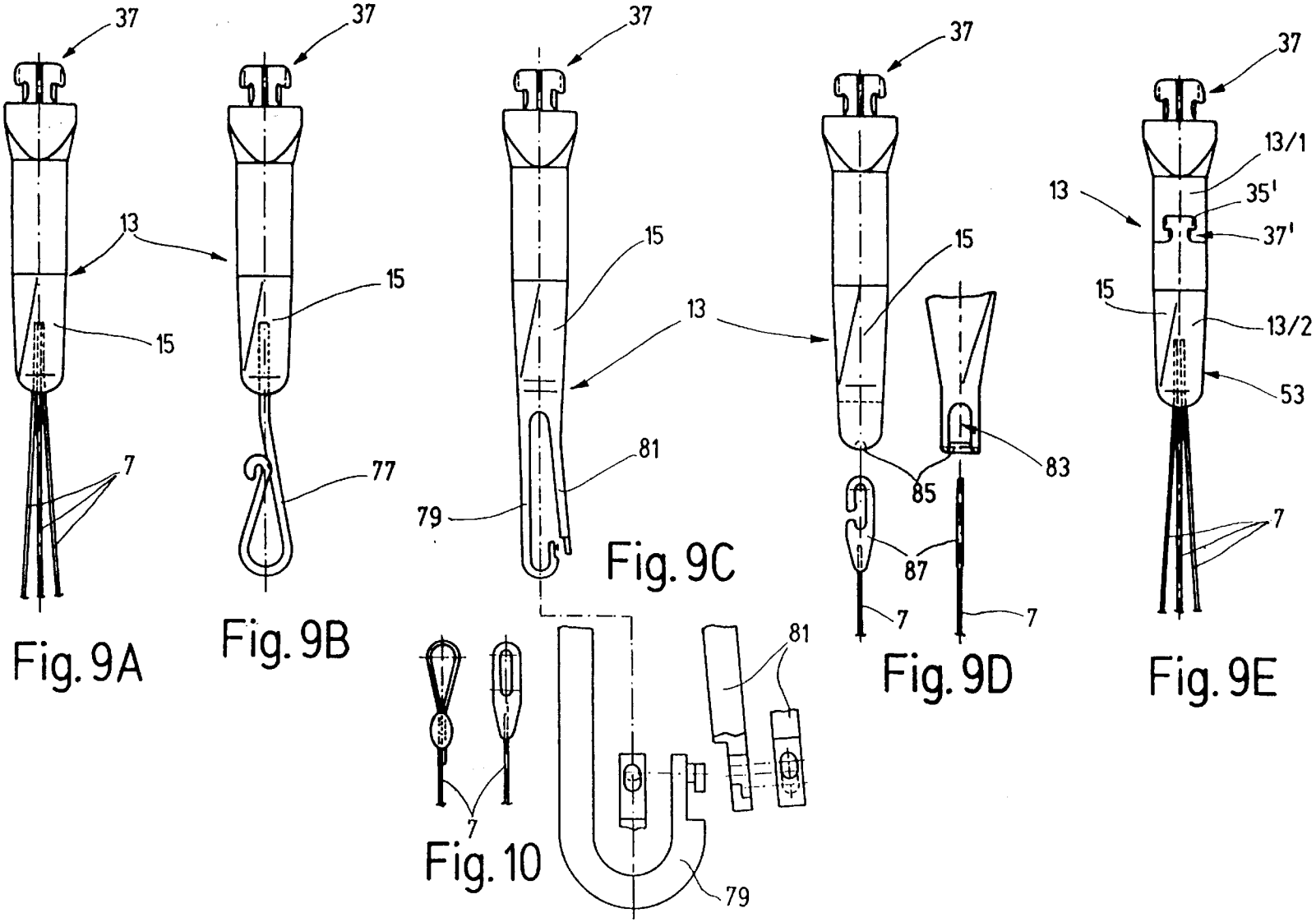
FIGS. 9A to 9E each show a side view of a coupling part capable of being connected to a harness cord.
FIG. 10 shows an enlarged illustration of part of the coupling part illustrated in FIG. 9C and a side view of two harness cords at their end facing the coupling device.

In the exemplary embodiment illustrated in FIG. 9A, altogether three harness cords 7 are injection-molded directly onto the coupling part 13. In the exemplary embodiment illustrated in FIG. 9B, a hook 77 consisting of metal or plastic is injection-molded on the second coupling part 13 or injection-molded directly together with the coupling part 13, and a harness cord or a plurality of harness cords, which are provided, for example, with a loop at the end, can be unhooked and hung up again individually or in groups on the hooks, for example for individual repairs. By virtue of this design, it is possible, furthermore, to exchange a defective positioning element. Moreover, it is possible for the coupling part 13 itself also to be designed in its end region as a hook 79, as illustrated in FIG. 9C. The hook 79 is capable of being closed by means of a tongue-like closing element 81 which is likewise connected in one piece to the coupling part 13. In the exemplary embodiment of the coupling part 13 illustrated in FIG. 9D, the latter has, on its end region cooperating with the harness cord, a downwardly open-edged U-shaped recess 83 having two lateral surfaces which are arranged parallel to one another and which are connected by means of a bolt 85. A hook 87 connected to a harness cord 7 or to a plurality of harness cords can be suspended on the bolt 85 or, if the hook 87 is designed accordingly, snapped onto the bolt. As is evident from FIG. 9D, the U-shaped recess 83 is arranged below the aligning cone frustum (cross-sectional portion 15).

In order to simplify the exchange of the positioning element 21 assigned to the second coupling part 13, but not illustrated in FIGS. 9A to 9E, the second coupling part 13 of the exemplary embodiment illustrated in FIG. 9E is formed by two coupling parts 13/1 and 13/2 releasably connected to one another. The coupling part 13/1 has, at one end facing the first coupling part 11 (not illustrated), a holding projection 37 and, at the other end, a receptacle 35', into which the holding projection 37' of the coupling part 13/2 can be radially moved or snapped, at the other end of the coupling part 13/2 the latter having the cone frustum 53 for the rotational alignment of the second coupling part 13. Of course, the other exemplary embodiments of the coupling part 13 which are described with reference to FIGS. 9A to 9D may also have an additional coupling point of this kind, having a plurality of individual parts releasably connectable to one another.

FIG. 10 shows an enlarged illustration of the hook 79 which is connected in one piece to the coupling part 13 illustrated in FIG. 9C and which is capable of being closed by means of a closing element 81. The two pictures on the left in FIG. 10 each show the end region of a harness cord 7, and in these end regions a connection point is injection-molded on one harness cord 7, that on the left, in order to form a loop and a tab having a recess is injection-molded on the other harness cord located on the right. Furthermore, in order to form a loop, it is known to knot the harness cord in its end region.

Figures 11A, 11B, 11C:
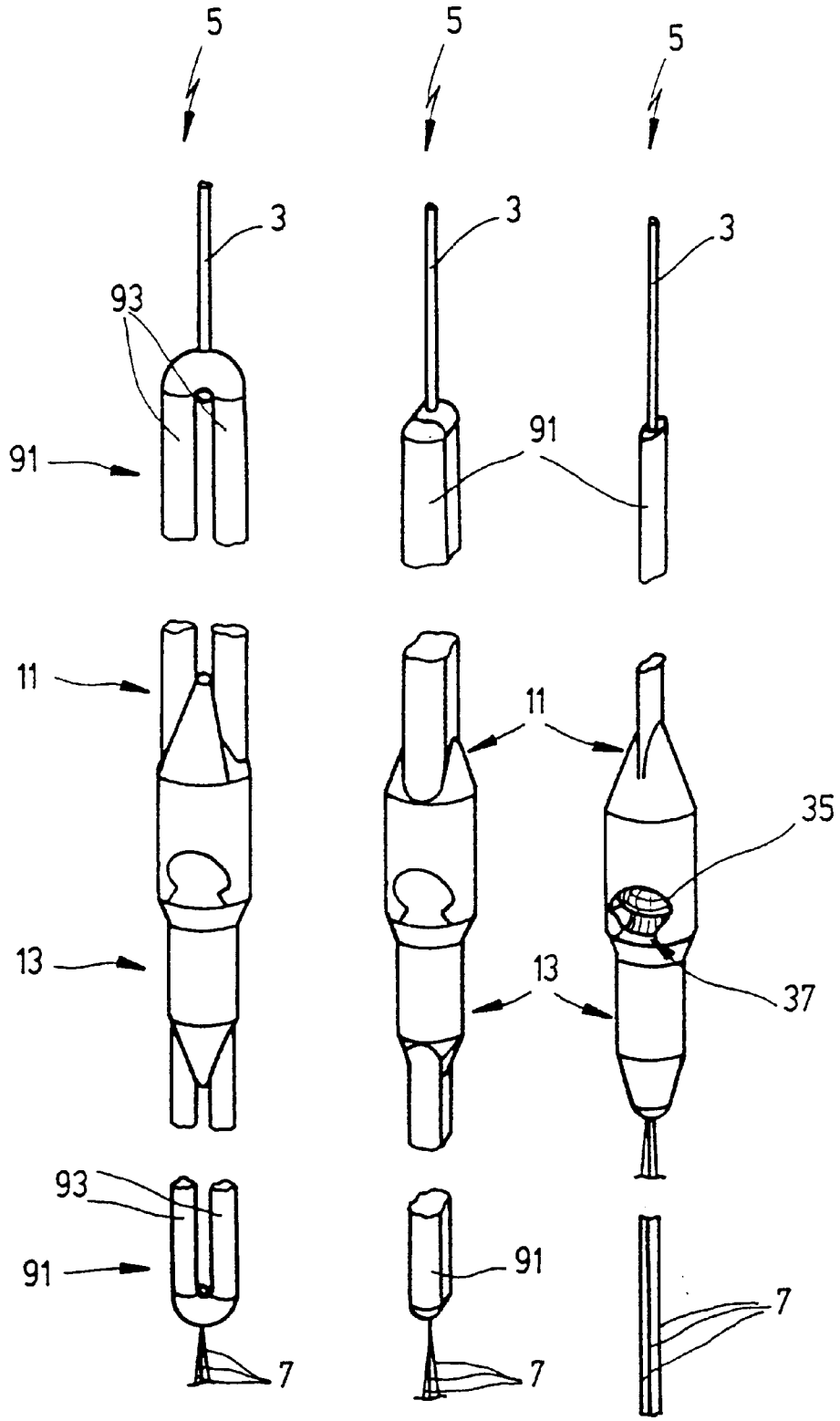
FIGS. 11A to 11C in each case show a perspective illustration of further exemplary embodiments of the coupling device.

FIGS. 11A to 11C in each case show a perspective illustration of a further exemplary embodiment of a coupling device 5. The coupling device 5 illustrated in FIG. 11A comprises two coupling parts 11 and 13 which each have a shank 91 formed by two round bars 93 connected to one another. The shank of the first coupling part 11 is guided by means of a passage orifice of a first positioning element, not illustrated, the passage orifice having a shaping adapted to the shaping of the shank, and the shank 91 of the second coupling part 13 is guided into a corresponding passage orifice of a second positioning element which is not illustrated. The shank 91 is thinner than the remaining regions of the coupling part 11, 13. The surfaces of friction with the passage orifices of oval or rectangular cross section in the positioning elements when the jacquard machine is in operation are consequently relatively small. The cross-sectional surface of the shank 91 may, in principle, have virtually any desired design. It is necessary merely to ensure that lateral alignment of the coupling parts is maintained. It becomes clear that the coupling parts 11, 13 are rotationally aligned only when being introduced into the passage orifice of the positioning elements and, while the jacquard machine is in operation, remain constantly preoriented and slide back and forth in the passage orifices. The coupling device 5 is coupled and uncoupled, here too, by means of a radial relative movement of the coupling parts 11, 13.

The exemplary embodiment of the coupling device 5 illustrated in FIG. 11B differs from the exemplary embodiment described with reference to FIG. 11A only in that the shanks 91 have an oval cross section or rectangular cross section with rounded lateral edges.

In the exemplary embodiment of the coupling device 5 illustrated in FIG. 11C, only the first coupling part 11 has to be rotationally aligned in order to couple the two coupling parts 11, 13, since the second coupling part 13 has a holding projection 37 which is designed spherically, so that the latter can be moved or pressed into the receptacle 35 of the first coupling part 11 in any laterally rotated position of the second coupling part 13. A shank may therefore be dispensed with in the second coupling part 13. The shank 91 having an oval cross section is relatively thin, as compared with the shank 91 illustrated in FIG. 11B.

The exemplary embodiments illustrated in FIGS. 11A to 11C have in common the fact that the shanks 91 are somewhat longer than the maximum shared stroke. As an alternative to the shank 91, the coupling parts 11, 13 may also have a guide band which engages through the passage orifice in the positioning elements, but in this exemplary embodiment the longitudinal portion of the coupling parts in which the holding projection and receptacle are respectively provided must be designed to be somewhat longer, so that this region of the coupling parts themselves can be guided in the passage orifice of the positioning elements for the purpose of absorbing the coupling forces.

Figure 12:
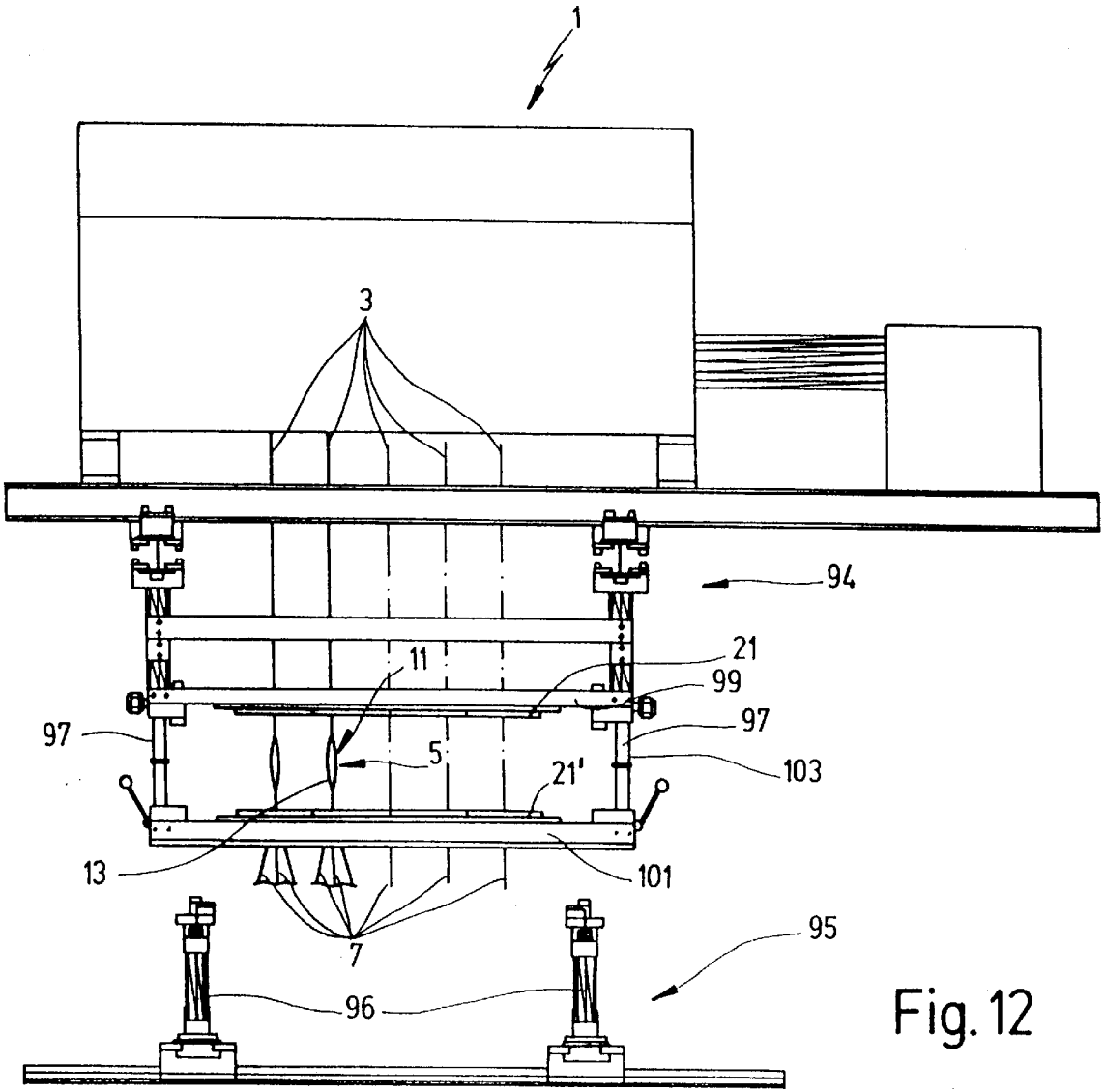
FIG. 12 shows a side view of a substructure of a jacquard machine with a changing device for the simultaneous coupling and uncoupling of a plurality of coupling devices.

FIG. 12 shows a side view of a jacquard machine 1 and a substructure arranged below the latter, with a changing device 94 for the simultaneous connection and release of a plurality, for example hundreds or thousands, of radially couplable/uncouplable coupling devices for harness cords 7 or the like, such as are described, for example, with reference to the previous figures. The changing device 94 comprises a plurality of, for example four, guide columns 97, on which an upper guide frame 99 and a lower guide frame 101 are guided in the axial direction, that is to say vertically. The positioning element 21 assigned or capable of being assigned to the first coupling parts 11 is attached to the upper guide frame 99 and the positioning element 21' capable of being assigned or assigned to the second coupling parts 13 is attached to the lower guide frame 101, in this exemplary embodiment the positioning element 21' being displaceable in the guide frame 101 transversely to the longitudinal extent of the guide columns 97. It is, of course, also possible, alternatively, for both positioning elements 21, 21' or only the positioning element 21 to be radially displaceable for coupling and uncoupling. The displacement of the guide frames 99 and 101 in the vertical direction takes place by means of a plurality of displacement arrangements which are formed, here, by piston/cylinder units 96 and which are part of an auxiliary changing device 95 arranged below the changing device 94. The piston/cylinder units comprise, here, in each case at least two pistons extendable in the vertical direction and at least one piston extendable in the radial direction. It also remains to be pointed out that the auxiliary changing device 95, which operates, for example, mechanically, pneumatically, hydraulically, electrically or the like, is located movably on a carriage or is arranged removably on the stand of the jacquard machine.

When a new harness is hung up, first the positioning element 21' with the harness is moved from below, by first pistons being extended out of the cylinders, into the lower guide frame 101 and is fastened there. By means of a further vertical lifting movement of the piston/cylinder units 96, the positioning element 21' together with the guide frame 101 is raised in order to couple the coupling devices 5 and is moved from below up against the stop 103. Finally, the positioning element 21' is displaced in the guide frame 101 with the aid of the third piston displaceable in the radial direction. At the same time, the two coupling parts 11, 13 are pushed laterally one into the other and interlocked, so that the coupling devices 5 are closed. The second positioning element 21 attached to the upper guide frame 99 is then moved away from the stop 103 by the second pistons of the piston/cylinder units 96 being extended and is displaced upward into its position of rest illustrated in FIG. 12. The first pistons of the piston/cylinder units 96 are subsequently retracted, with the result that the positioning element 21' displaceably attached to the guide frame 101 is moved into the lower position of rest illustrated in FIG. 12. The positioning elements 21 and 21', moved apart from one another in this way, are detained in their positions of rest on the guide columns 97 by fastening means, for example quick-action locking means. In this position, when the jacquard machine 1 is in operation, the coupling devices 5 can be moved vertically within the scope of the shared stroke, without butting onto the positioning elements 21, 21'. The uncoupling of the harness from the jacquard machine, which can be carried out quickly, takes place in reverse order.

Instead of the mechanical stop 103, it is also possible to employ sensors, with the aid of which the displacement movement of the guide frames can be controlled or regulated.

It still remains to be noted that, when the harness is unhooked from the weaving machine, the second pistons of the piston/cylinder units 96 are moved as far as the upper guide frame 99 which is arranged in its position of rest and which is then released from the guide columns 97, lowered by means of a retracting movement of the second pistons and moved from above against the stop 103. With the aid of the auxiliary changing device 95, therefore, a defined displacement both of the lower guide frame 101 and of the upper guide frame 99 in the vertical direction is possible.

As an alternative to the exemplary embodiment described with reference to FIG. 12, in another exemplary embodiment of the jacquard machine it is possible to raise the lifting elements 3, such as the sinker cords or the like, together with the first coupling parts attached to them, into the position in which the upper guide frame 99 is illustrated in FIG. 12. In this exemplary embodiment, during coupling and uncoupling the upper guide frame may be fixed in its upper position of rest, so that the coupling operation can be carried out in this height position and only the lower guide frame together with the lower positioning element 21' has to be moved horizontally and/or vertically.

Although the present invention has been described in relation to particular embodiments thereof, many other variations and modifications and other uses will become apparent to those skilled in the art. Therefore, the present invention is to be limited not by the specific disclosure herein, but only by the appended claims.

What is claimed is:

1. A coupling device for releasably connecting a lifting element to at least one harness cord of a weaving machine, the coupling device comprising:

a first elongated coupling part having a first end and a second end, the first end being adapted for connection to the lifting element; and a second elongated coupling part having a first end and a second end, the first end being adapted for connection to the harness cord;

the first and second coupling parts being operable to interlock with each other at their respective second ends when the coupling parts are in a selected rotational and longitudinal alignment relative to each other and are moved toward each other in a direction transverse to their respective axes of elongation, and to disengage when the coupling parts are moved away from each other in the transverse direction;

at least one of the coupling parts including a rotational alignment member adapted to engage with a locating tool for rotational alignment of the two coupling parts to one another.

2. The coupling device of claim 1, wherein the first end of the first coupling part includes a connector for connection to a sinker cord of a jacquard machine.

3. The coupling device of claim 1, wherein the first end of the second coupling part includes a connector for connection to the harness cord.

4. The coupling device of claim 1, wherein the rotational alignment member is comprised of a portion of the coupling part having a non-circular cross-section with which the locating tool engages to rotationally align the coupling parts.

5. The coupling device of claim 1, wherein the non-circular cross-sectional portion is twisted axially on itself.

6. The coupling device of claim 1, wherein the rotational alignment member is comprised of a cam on the surface of the coupling part which is adapted to engage with a follower on the locating tool and to rotate the coupling part when the locating tool is moved axially relative to the coupling part.

7. The coupling device of claim 1, wherein:

one of the coupling parts includes a receptacle at its second end; and the other coupling part includes a holding projection which engages with the receptacle when the coupling parts are rotationally and longitudinally aligned, and are moved transversely relative to each other in relation to their respective axes of elongation.

8. The coupling device of claim 7, wherein the holding projection has a tapered neck portion at the end closest to the first end of the coupling part, and a cross-sectional widening adjoining the neck at the second end of the coupling part, and the receptacle has a region of cross-sectional narrowing at one end which receives the tapered neck of the holding projection.

9. The coupling device of claim 7, wherein the holding projection is T-shaped, and the receptacle has a T-shaped opening which receives the holding projection.

10. The coupling device of claim 7, wherein, the receptacle has an interior wall and at least one latching projection extending from the interior wall, the projection resiliently engaging with the holding projection to provide a snap fit.

11. The coupling device of claim 10, wherein the latching projection comprises a curved rib which engages a latching recess behind the holding projection.

12. The coupling device of claim 11, wherein the latching projection and the latching recess include portions having complementary curvature.

13. The coupling device of claim 12, further including a latching projection which engages with the receptacle to widen the opening thereof when the coupling parts connect and disconnect.

14. The coupling device of claim 7, wherein the holding projection is claw shaped.

15. The coupling device of claim 7, wherein at least one of the coupling parts is of two-part construction, with a first section including the holding projection and a second section including the rotational alignment member, the first and second sections being releasably connected to one another.

16. A system comprising:

a jacquard machine;

a weaving machine positioned below the jacquard machine;

a plurality of sinker cords extending downwardly from the jacquard machine;

a plurality of harness cords for lifting warp threads on the weaving machine;

a plurality of releasable coupling devices, each coupling device comprising:

a first elongated coupling part having a first end which connects to one of the sinker cords and a second end; and a second elongated coupling part having a first end which connects to at least one of the harness cords, and a second end;

the coupling parts being operable to interlock with each other at their respective second ends when the coupling parts are in a selected rotational and longitudinal alignment relative to each other and are moved toward each other in a direction transverse to their respective axes of elongation, and to disengage when the coupling parts are moved away from each other in the transverse direction; and a positioning mechanism including first and second positioning elements which respectively engage with the first and second coupling parts to position the coupling parts in the selected rotational and longitudinal alignment relative to each other and to interlock and release the coupling parts by moving them toward and away from each other in a direction transverse to their respective axes of elongation.

17. The system of claim 16, wherein at least one of the coupling parts includes a rotational alignment member which cooperates with the associated positioning mechanism to rotationally align the two coupling parts to one another.

18. The system of claim 17, wherein the rotational alignment member is comprised of a portion of the coupling part having a non-circular cross-section with which the associated positioning mechanism engages to rotationally align the coupling parts.

19. The system of claim 18, wherein the non-circular cross-sectional portion of the rotational alignment member is twisted axially on itself.

20. The system of claim 16, wherein:

one of the coupling parts includes a receptacle at its second end; and the other coupling part includes a holding projection which engages with the receptacle when the coupling parts are rotationally and longitudinally aligned, and are moved transversely relative to each other in relation to their respective axes of elongation.

21. The system of claim 16, wherein the positioning mechanism comprises:

a supporting frame positioned between the jacquard machine and the weaving machine and including a plurality of substantially vertical guide columns;

first and second guide frames being movably mounted on the guide columns, the guide frames respectively supporting the first and second positioning elements in vertically spaced relationship, with at least one of the positioning elements being movable horizontally in its supporting guide frame;

first and second actuators which raise and lower the first and second guide frames on the guide columns;

the first guide frame being positioned to engage the first positioning element and the first coupling parts when the guide frame is lowered on the guide columns and to disengage the first positioning element from the first coupling parts when the guide frame is raised;

the second guide frame being positioned to engage the second positioning element and the second coupling parts when the guide frame is raised on the guide columns and to disengage the second positioning element from the second coupling parts when the guide frame is lowered;

a position control device which sets the first and second positioning elements at the proper vertical positions to rotationally align and permit interlocking the first and second coupling parts; and a third actuator mechanism which moves the movable positing element in a direction transverse to the axes of elongation of the coupling parts when the coupling parts are to be interlocked and released.

22. The system of claim 21, wherein the first positioning element includes a plurality of passages extending in the direction of elongation of the coupling devices, which engage with respective ones of the first coupling parts as the first positioning element is moved downwardly and disengage from the respective ones of the first coupling parts as the first positioning element is moved upwardly, wherein the second positioning element includes a plurality of passages extending in the direction of elongation of the coupling devices, which engage with respective ones of the second coupling parts as the second positioning element is moved upwardly and disengage from the respective ones of the first coupling parts as the second positioning element is moved downwardly away from the position set by the position control device, and wherein the coupling devices include rotational alignment members on at least one of their respective coupling parts which cooperate with the openings in the associated positioning element to rotationally align the coupling parts as the positioning elements engage with the respective coupling parts and move toward the positions set by the position control device.

23. The system of claim 22, wherein the position control device is comprised of stop members mounted on the guide columns.

24. The system of claim 22, wherein the rotational alignment members are comprised of cams on the surfaces of the coupling parts which engage with followers on the inner surfaces of the openings in the associated positioning elements to rotate the coupling part as the positioning elements move toward the positions set by the position control device.

25. The system of claim 22, wherein the sinker cords pass through the openings in the first positioning element and the harness cords pass through the openings in the second positioning element.

26. The system of claim 21, wherein the first and second actuators are further operative to raise the first guide frame and lower the second guide frame to standby positions such that the openings in the positioning elements do not interfere with vertical movement of the coupling devices when the jacquard machine is in operation.

* * * * *